US009353600B2

(12) United States Patent
Cong et al.

(10) Patent No.: US 9,353,600 B2
(45) Date of Patent: May 31, 2016

(54) RESETTABLE REMOTE AND MANUAL ACTUATED WELL TOOL

(71) Applicant: Halliburton Energy Services, Inc., Houston, TX (US)

(72) Inventors: Ryan Foong Zhe Cong, Scotland (GB); Vijay Kumar Keerthivasan, Scotland (GB)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 14/423,058

(22) PCT Filed: Sep. 25, 2013

(86) PCT No.: PCT/US2013/061734
§ 371 (c)(1),
(2) Date: Feb. 20, 2015

(87) PCT Pub. No.: WO2015/047254
PCT Pub. Date: Apr. 2, 2015

(65) Prior Publication Data
US 2016/0032687 A1 Feb. 4, 2016

(51) Int. Cl.

| | |
|---|---|
| ***E21B 34/16*** | (2006.01) |
| ***E21B 47/18*** | (2012.01) |
| ***E21B 41/00*** | (2006.01) |
| ***E21B 34/10*** | (2006.01) |
| ***E21B 34/12*** | (2006.01) |
| ***E21B 23/00*** | (2006.01) |
| *E21B 34/00* | (2006.01) |

(Continued)

(52) U.S. Cl.
CPC ..... *E21B 34/16* (2013.01); *E21B 23/006* (2013.01); *E21B 34/10* (2013.01); *E21B 34/12* (2013.01); *E21B 41/00* (2013.01); *E21B 47/18* (2013.01); *E21B 34/14* (2013.01); *E21B 43/12* (2013.01); *E21B 2034/002* (2013.01); *E21B 2034/007* (2013.01)

(58) Field of Classification Search
CPC ... E21B 2034/002; E21B 34/16; E21B 34/12; E21B 34/14; E21B 47/18; E21B 23/006; E21B 43/12
See application file for complete search history.

(56) References Cited

U.S. PATENT DOCUMENTS 3,912,008 A 10/1975 Crowe
4,051,899 A 10/1977 Fredd (Continued)

FOREIGN PATENT DOCUMENTS

WO WO2012166418 12/2012

OTHER PUBLICATIONS

Authorized Officer Chang Ho Lee, PCT International Search Report and Written Opinion, International Application No. PCT/US2013/061734, Jun. 25, 2014, 15 pages.

*Primary Examiner* — Shane Bomar
(74) *Attorney, Agent, or Firm* — Scott Richardson; Fish & Richardson P.C.

(57) ABSTRACT

A well tool has a housing and an actuator sleeve in the housing. An actuator in the housing includes a spring and an internal shifting tool engaging profile. The actuator is responsive, independent of well annulus pressure, to a remote hydraulic signal in a central bore of the well tool to change from an unactuated state to an actuated state to shift the actuator sleeve from a first position to a second position. The actuator is responsive to reset to the unactuated state using the internal shifting tool engaging profile.

22 Claims, 6 Drawing Sheets

(51) Int. Cl.
*E21B 43/12* (2006.01)
*E21B 34/14* (2006.01)

(56) References Cited

U.S. PATENT DOCUMENTS

| | | | | |
|---|---|---|---|---|
| 4,403,659 | A | 9/1983 | Upchurch | |
| 4,651,969 | A * | 3/1987 | Dowdall | E21B 34/04 251/14 |
| 4,655,288 | A | 4/1987 | Burris, II et al. | |
| 4,723,606 | A | 2/1988 | Vinzant et al. | |
| 5,810,087 | A | 9/1998 | Patel | |
| 5,950,733 | A | 9/1999 | Patel | |
| 6,230,807 | B1 | 5/2001 | Patel | |
| 6,289,999 | B1 * | 9/2001 | Dewey | E21B 23/006 175/232 |
| 6,328,109 | B1 | 12/2001 | Pringle et al. | |
| 6,433,991 | B1 * | 8/2002 | Deaton | E21B 23/00 166/65.1 |
| 6,523,613 | B2 | 2/2003 | Rayssiguier et al. | |
| 7,740,075 | B2 | 6/2010 | Goughnour et al. | |
| 8,261,817 | B2 | 9/2012 | Hayter et al. | |
| 2002/0046834 | A1 | 4/2002 | Rayssiguier et al. | |
| 2012/0199364 | A1 | 8/2012 | Frosell | |
| 2013/0092399 | A1 | 4/2013 | Giroux et al. | |
| 2013/0213673 | A1 | 8/2013 | Crabb et al. | |
| 2014/0124195 | A1 * | 5/2014 | Tahoun | E21B 21/103 166/250.01 |

* cited by examiner

RESETTABLE REMOTE AND MANUAL ACTUATED WELL TOOL

CLAIM OF PRIORITY

This application is a 371 U.S. National Phase Application of and claims the benefit of priority to International Application No. PCT/US2013/061734, filed on Sep. 25, 2013 and entitled "Resettable Remote and Manual Actuated Well Tool", the entire contents of which are hereby incorporated by reference.

BACKGROUND

This disclosure relates to remotely and mechanically actuated tools for use in subterranean well systems.

There are numerous tools for use in a subterranean well that can be remotely actuated by a hydraulic, electric, and/or other type of signal generated remote from the tool. Some of these tools further include provisions for mechanical actuation, for example, by a shifting tool manipulated from the surface. The mechanical actuation provides an alternative or contingency mode of actuation apart from actuation in response to the remote signal.

DESCRIPTION OF DRAWINGS

FIG. 2A shows the example valve in an open position. FIG. 2B shows the example valve in a closed position.

FIG. 3 is a half cross-sectional view of the fluid isolation portion. FIG. 4A is a half cross-sectional view of the trigger/reset section in an unactuated state. FIG. 4B is a half cross-sectional view of the trigger/reset section immediately upon actuating the actuator. FIG. 4C is a half cross-sectional view of the trigger/reset section in an actuated state. FIG. 4D is a half cross-sectional view of the trigger/reset section having been reset to an unactuated state.

Like reference symbols in the various drawings indicate like elements.

DETAILED DESCRIPTION

Figure 1:
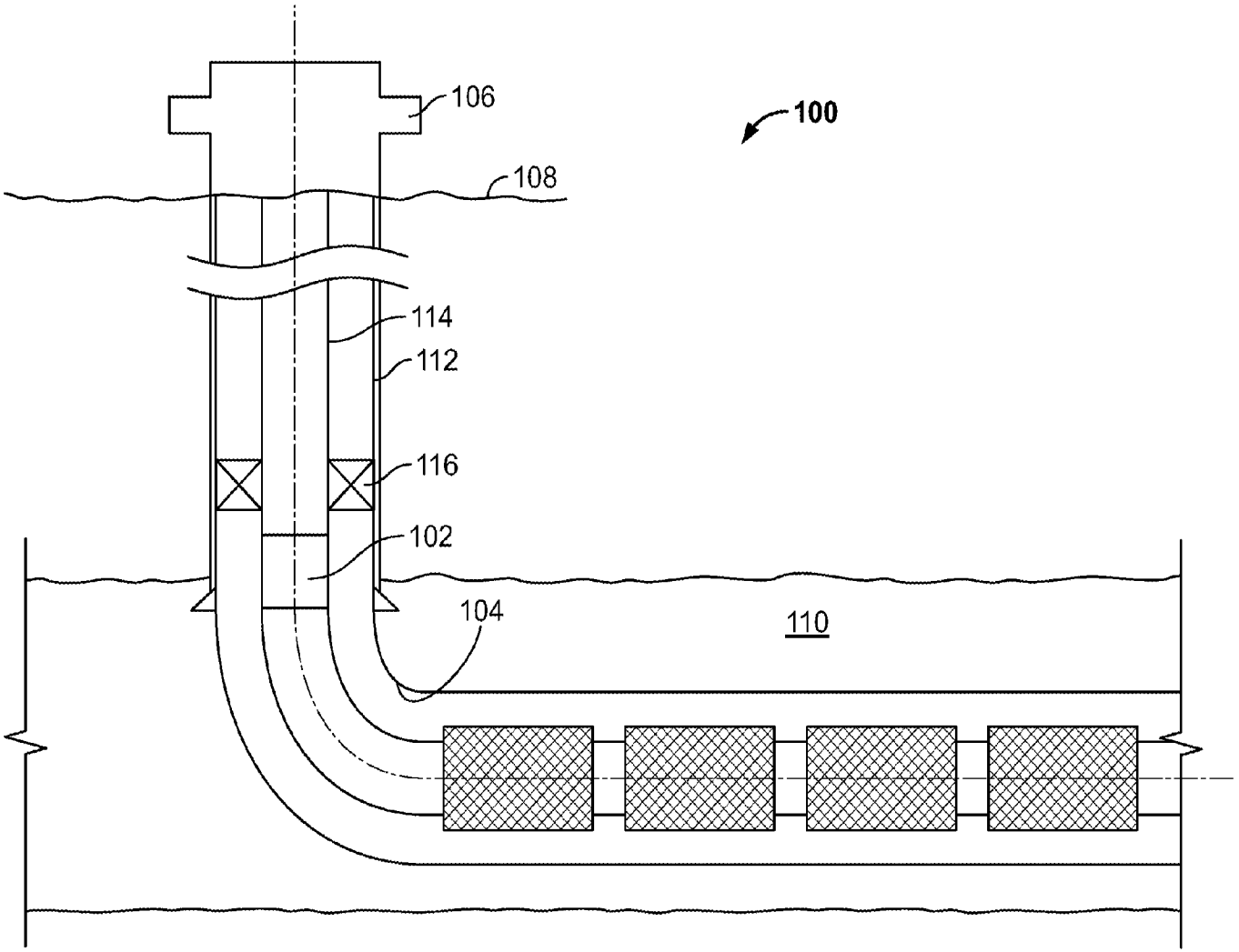
FIG. 1 is a side cross-sectional view of an example well system.

FIG. 1 is a side cross-sectional view of a well system 100 with an example valve 102 constructed in accordance with the concepts herein. The well system 100 is provided for convenience of description only, and it should be appreciated that the concepts herein are applicable to a number of different configurations of well systems. As shown, the well system 100 includes a substantially cylindrical well bore 104 that extends from a well head 106 at a surface 108 (here, a terranean surface) through one or more subterranean zones of interest 110. In FIG. 1, the well bore 104 extends substantially vertically from the surface 108 and deviates to horizontal in the subterranean zone 110. However, in other instances, the well bore 104 can be of another configuration, for example, entirely substantially vertical or slanted, it can deviate in another manner than horizontal, it can be a multi-lateral, and/or it can be of another configuration. Likewise, although shown as a land-based well in FIG. 1, in other instances, the well system 100 can be a subsea or offshore well.

The well bore 104 is lined with a casing 112, constructed of one or more lengths of tubing, that extends from the well head

106 at the surface 108, downhole, (to the right in FIG. 1) toward the bottom of the well bore 104. The casing 112 provides radial support to the well bore 104 and seals against unwanted communication of fluids between the well bore 104 and surrounding formations. Here, the casing 112 ceases at the subterranean zone 110 and the remainder of the well bore 104 is an open hole, i.e., uncased. In other instances, the casing 112 can extend to the bottom of the well bore 104 or can be provided in another configuration.

A completion string 114 of tubing and other components is coupled to the well head 106 and extends, through the well bore 104, downhole, into the subterranean zone 110. The completion string 114 is the tubing that is used, once the well is brought onto production, to produce fluids from and/or inject fluids into the subterranean zone 110. Prior to bringing the well onto production, the completion string is used to perform the final steps in constructing the well. The completion string 114 is shown with a packer 116 above the subterranean zone 110 that seals the wellbore annulus between the completing string 114 and casing 112, and directs fluids to flow through the completion string 114 rather than the annulus.

The example valve 102 is provided in the completion string 114 below the packer 116. The valve 102, when open, allows passage of fluid and communication of pressure through the completion string 114. When closed, the valve 102 seals against passage of fluid and communication of pressure between the lower portion of the completion string 114 below the valve 102 and the upper portion of the completion string 114. The valve 102 has provisions for both mechanical and remote operation. As described in more detail below, for mechanical operation, the valve 102 has an internal profile that can be engaged by a shifting tool to operate the valve. For remote operation, the valve 102 has an actuator assembly that responds to a signal (e.g., a hydraulic, electric, and/or other signal) to operate the valve. The signal can be a remote signal generated remote from the valve 102, for example at the surface, in the wellbore, and/or at another location. After remote actuation, the valve 102 has provisions to be reset to enable the valve 102 to be remotely actuated again.

In the depicted example, the valve 102 is shown as a fluid isolation valve that is run into the well bore 104 open, mechanically closed with a shifting tool and then eventually re-opened in response to a remote signal. The valve 102 thus allows an operator to fluidically isolate the subterranean zone 110, for example, while an upper portion of the completion string 114 is being constructed, while subterranean zones above the valve 102 are being produced (e.g., in a multilateral well), and for other reasons. The concepts herein, however, are applicable to other configurations of valves. For example, the valve 102 could be configured as a safety valve. A safety valve is typically placed in the completion string 114 or riser (e.g., in a subsea well), and is biased closed and held open by a remote signal. When the remote signal is ceased, for example, due to failure of the well system above the valve 102, the valve 102 closes. Thereafter, the valve 102 is mechanically re-opened to recommence operation of the well. The concepts herein are likewise applicable to an array of other types of well tools, including sliding sleeves, inflow control devices, packers and/or other well tools.

Figure 2A:
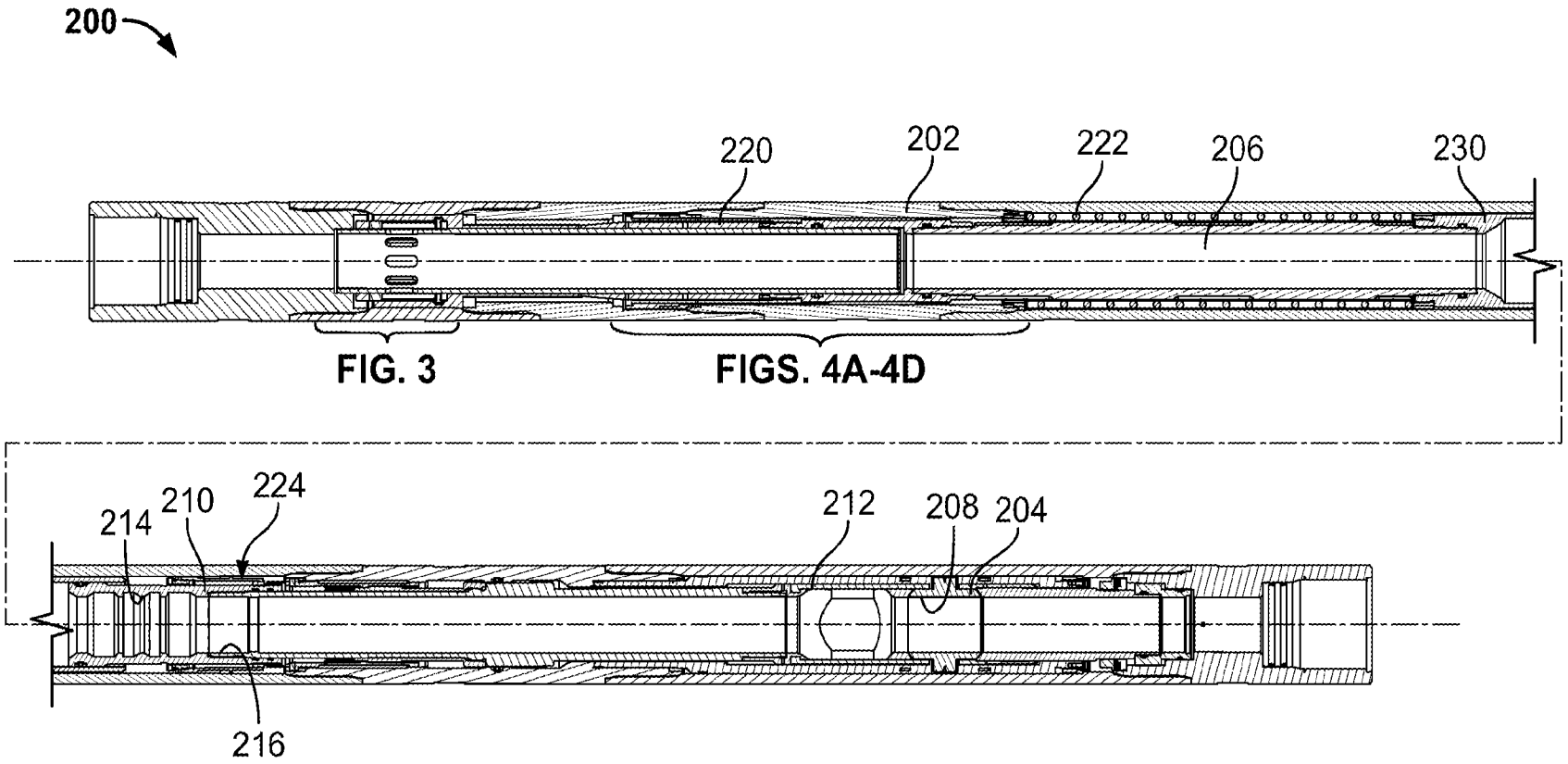
FIGS. 2A and 2B are detail side cross-sectional views of an example valve.
Figure 2B:
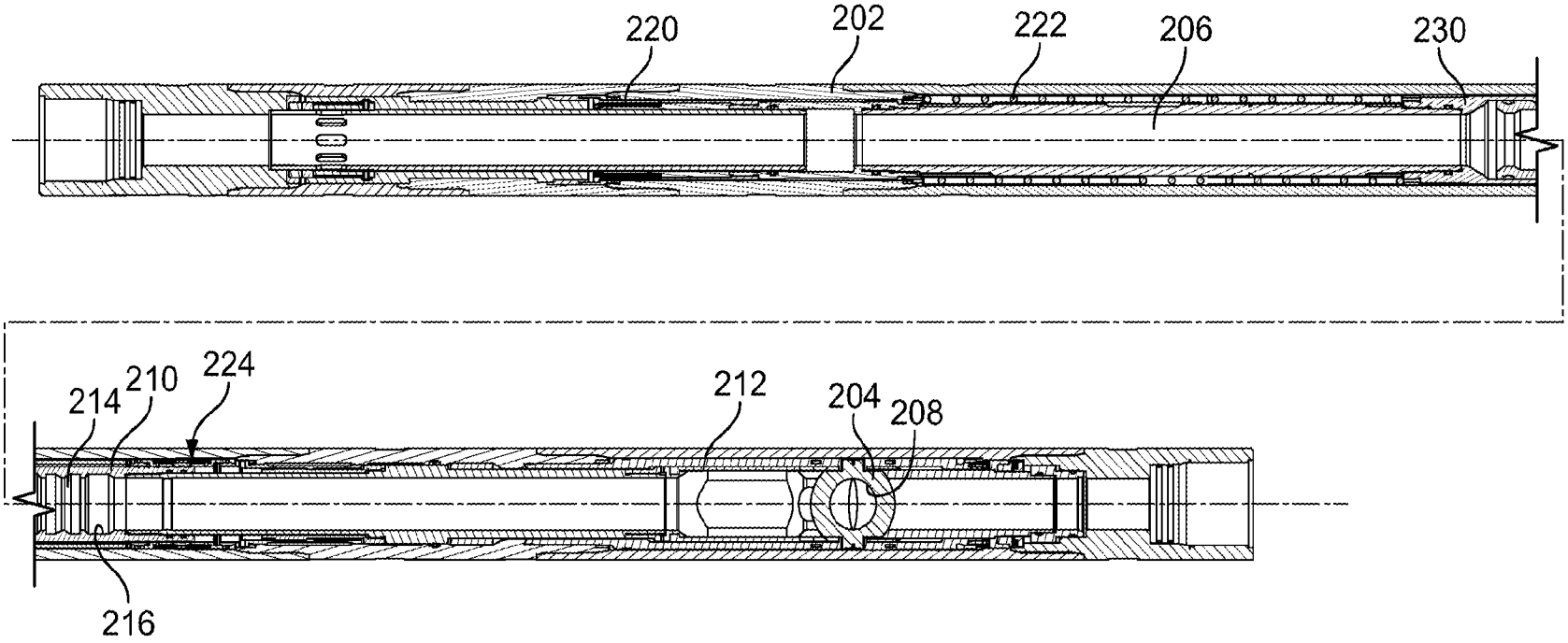

Turning now to FIGS. 2A and 2B, an example valve 200 is depicted in half side cross-section. The example valve 200 can be used as valve 102. The valve 200 includes an elongate, tubular valve housing 202 that extends the length of the valve 200. The housing 202 is shown as made up of multiple parts for convenience of construction, and in other instances, could be made of fewer or more parts. The ends of the housing 202 are configured to couple to other components of the completion string (e.g., threadingly and/or otherwise). The components of the valve 200 define an internal, cylindrical central bore 206 that extends the length of the valve 200. The central bore 206 is the largest bore through the valve 200 and generally corresponds in size to the central bore of the remainder of the completion string. The housing 202 contains a spherical ball-type valve closure 204 that has a cylindrical central bore 208 that is part of and is the same size as the remainder of the central bore 206. The valve closure 204 is carried to rotate about an axis transverse to the longitudinal axis of the valve housing 202. The valve 200 is open when the central bore 208 of the valve closure 204 aligns with and coincides with the central bore 206 of the remainder of the valve 200 (FIG. 2A). The valve 200 is closed when the central bore 208 of the valve closure 204 does not coincide with, and seals against passage of fluid and pressure through, the central bore 206 of the remainder of the valve 200 (FIG. 2B). In other instances, the valve closure 204 can be another type of valve closure, such as a flapper and/or other type of closure.

The valve closure 204 is coupled to an elongate, tubular actuator sleeve 210 via a valve fork 212. The actuator sleeve 210 is carried in the housing 202 to translate between an uphole position (to the left in FIG. 2B) and a downhole position (to the right in FIG. 2A), and correspondingly move the valve fork 212 between an uphole position and a downhole position. When the actuator sleeve 210 and valve fork 212 are in the uphole position, the valve closure 204 is in the closed position. As the actuator sleeve 210 and valve fork 212 translate to the downhole position, the valve closure 204 rotates around a transverse axis to the open position.

The valve 200 has provisions for remote operation to operate the valve closure 204 in response to a remote signal. To this end, the valve 200 has a remote actuator assembly 220 that is coupled to the actuator sleeve 210. The actuator assembly 220 is responsive to the remote signal to shift the actuator sleeve 210 axially and change the valve between the closed and open positions. While the actuator assembly 220 can take a number of forms, depending on the desired operation of the valve, in certain instances of the valve 200 configured as a fluid isolation valve, the actuator assembly 220 is responsive to a specified number of pressure cycles provided in the central bore 208 to release a compressed power spring 222 carried in the housing 202 and coupled to the actuator sleeve 210. FIG. 2A shows the actuator assembly 220 in an unactauted state with the power spring 222 compressed. FIG. 2B shows the actuator assembly 220 in the actuated state with the power spring 222 expanded. As seen in the figure, the released power spring 222 expands, applies load to and moves the actuator sleeve 210 axially from the uphole position to the downhole position, and thus changes the valve closure 204 from the closed position to the open position. The pressure cycles are a remote signal in that they are generated remotely from the valve 200, for example, by repeatedly opening and closing another valve in the completion string at the surface, for example, in the well head.

After the valve has been operated in response to a remote signal, the valve 102 has provisions to allow it to be reset to operate again in response to a remote signal. To this end, the actuator assembly 220 includes an internal profile 232 that is configured to be engaged by a corresponding profile of a shifting tool preferential to profile 232. The shifting tool can be inserted into the valve 200 on a working string of tubing (jointed, coiled and/or other) and other components inserted through the completion string from the surface. The profile 232 enables the shifting tool to grip and manipulate a portion of the actuator assembly 220. Using the shifting tool, the actuator assembly 220 is manipulated to re-compress the power spring 222 and reset the remainder of the actuator assembly 220 to an unactuated state (FIG. 2A) that maintains the power spring 222 compressed until released again in response to a remote signal. Thus, the valve 102 can be operated in response to a remote signal, reset and operated in response to a remote signal multiple times, and as many as is desired.

The valve 102 has provisions for mechanical operation to allow operating the valve closure 204 with a shifting tool inserted through the central bore 206. To this end, the actuator sleeve 210 has a profile 214 on its interior bore 216 that is configured to be engaged by a shifting tool preferential to profile 214. As above, the shifting tool can be inserted into the valve 200 on a working string of tubing (jointed, coiled and/or other) and other components inserted through the completion string from the surface. The profile 214 enables the shifting tool to grip the actuator sleeve 210 and move it between the uphole position and the downhole position, thus operating the valve closure 204. The shifting tool can be inserted into the valve 200 on a working string of tubing (jointed, coiled and/or other) and other components inserted through the completion string from the surface.

In certain instances, a spring mandrel 230 carried with the power spring 222 outputs the actuation loads and axial movement from the actuator assembly 220 (i.e., outputs the force and movement of the power spring 222) to the actuator sleeve 210. The actuator sleeve 210 can include a coupler 224 that is abutted by the spring mandrel 230 when the power spring 222 expands to drive the actuator sleeve 210 to open the valve closure 204. The coupler 224, however, does not grip the spring mandrel 230, enabling the actuator sleeve 210 to be shifted between the uphole and downhole positions, apart from the spring mandrel 230, prior to operating the actuator assembly 220 remotely. In certain instances, the coupler 224 is releasable and/or frangible from the actuator sleeve 210 on specified conditions (e.g., when subjected to a specified force). After the actuator assembly 220 is operated by the remote signal, the spring mandrel 230 is in a downhole position. Releasing the releasable coupling 224 from the actuator sleeve 210 allows the actuator sleeve 210 to again move uphole and downhole, apart from the spring mandrel 230, and the valve closure 204 to again be operated manually with a shifting tool inserted through the central bore 206.

The valve 200 can thus be installed in the well bore and operated manually, with a shifting tool, to open and close one or multiple times, and as many times as is desired. Thereafter, the valve 200 can be left in a closed state and remotely operated to an open state via a remote signal. If desired, the valve 200 can then be reset and remotely operated to an open state one or multiple times, and as many times as is desired. Finally, after being opened by the remote signal, the valve 200 can then be operated manually, with a shifting tool, to open and close one or multiple times, and as many times as is desired.

Figure 3:
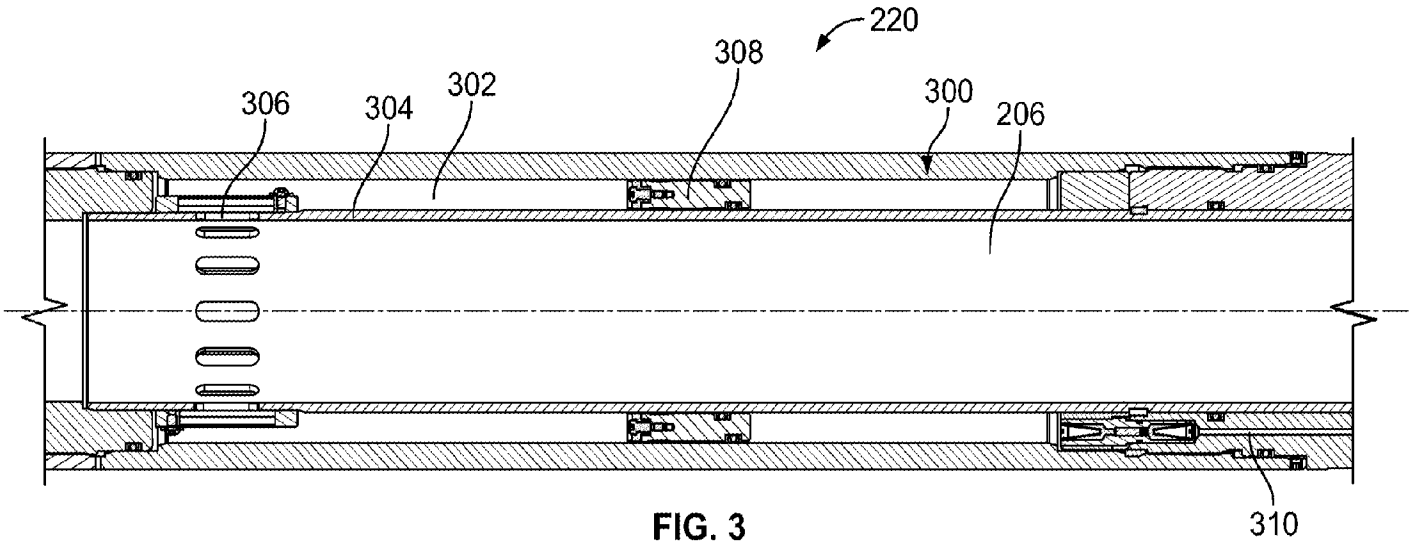
FIGS. 3, 4A-4D and 5 are detailed views of the example valve.

Turning now to FIG. 3, the actuator assembly 220 receives the remote signal from the central bore 206 into a fluid isolation portion 300 of the valve 102. The fluid isolation portion 300 operates to segregate the unclean wellbore fluids in the central bore 206 from the internals of the actuator assembly 220. The fluid isolation portion 300 includes an annular fluid isolation cavity 302 formed between a cylindrical sidewall sleeve 304 that defines a sidewall of the central bore 206 and the housing 202. The sidewall sleeve 304 includes one or more apertures 306 that allow fluid communication between the fluid isolation cavity 302 and the central bore 206. The fluid isolation cavity 302 carries a fluid isolation piston 308 to reciprocate axially within the cavity 302. The fluid isolation piston 308 is positioned downhole from the apertures 306 and sealed to the inner and outer walls of the fluid isolation cavity 302. Fluid pressure in the central bore 206 acts on the fluid isolation piston 308, but does not pass the piston 308. Rather, clean hydraulic fluid is maintained below the fluid isolation piston 308, and pressure in the central bore 206 is communicated, via the fluid isolation piston 308, to the clean hydraulic fluid. The clean hydraulic fluid is in fluid communication with a trigger/reset section 400 (FIG. 4A) of the actuator assembly 220 through a fluid passage 310 at the downhole end of the fluid isolation cavity 302. Operation of the fluid isolation piston 308 is independent of annulus pressure, because neither the clean hydraulic fluid nor the piston 308 are exposed to annulus pressure from outside of the valve 200.

Figure 4A:
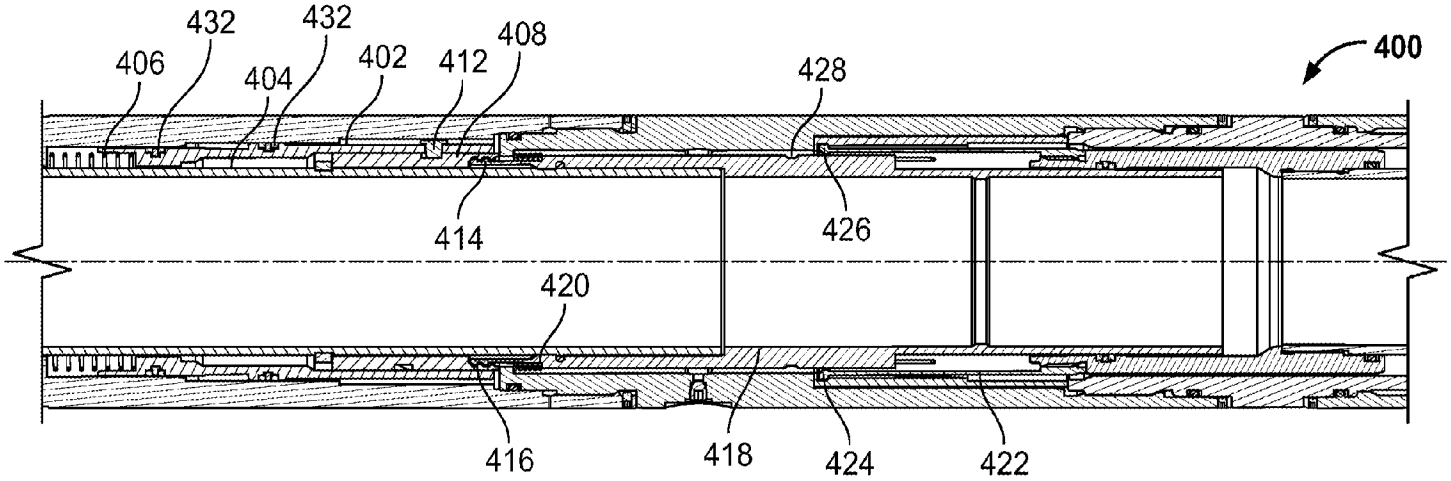
Figure 4B:
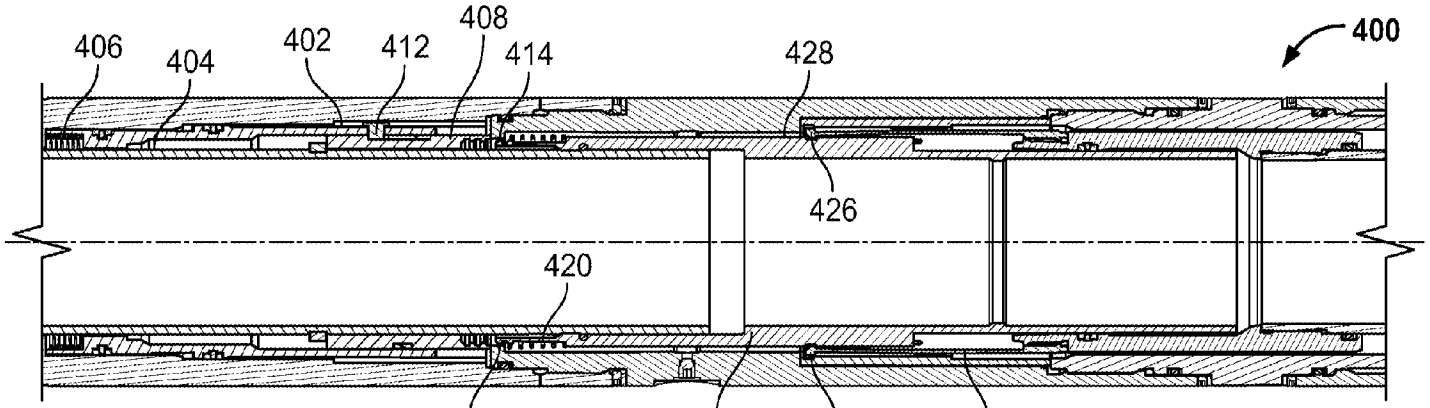
Figure 4C:
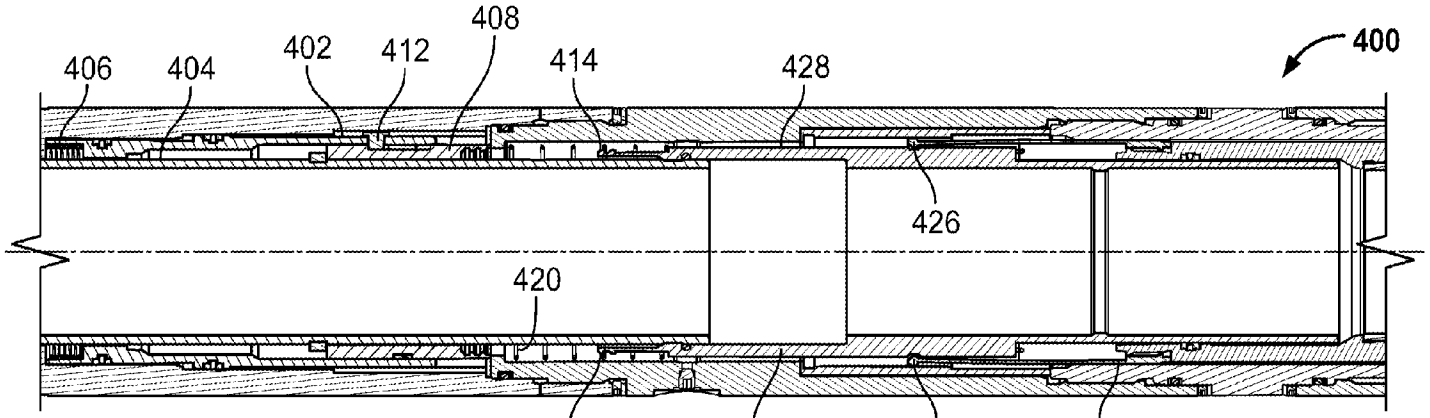
Figure 4D:
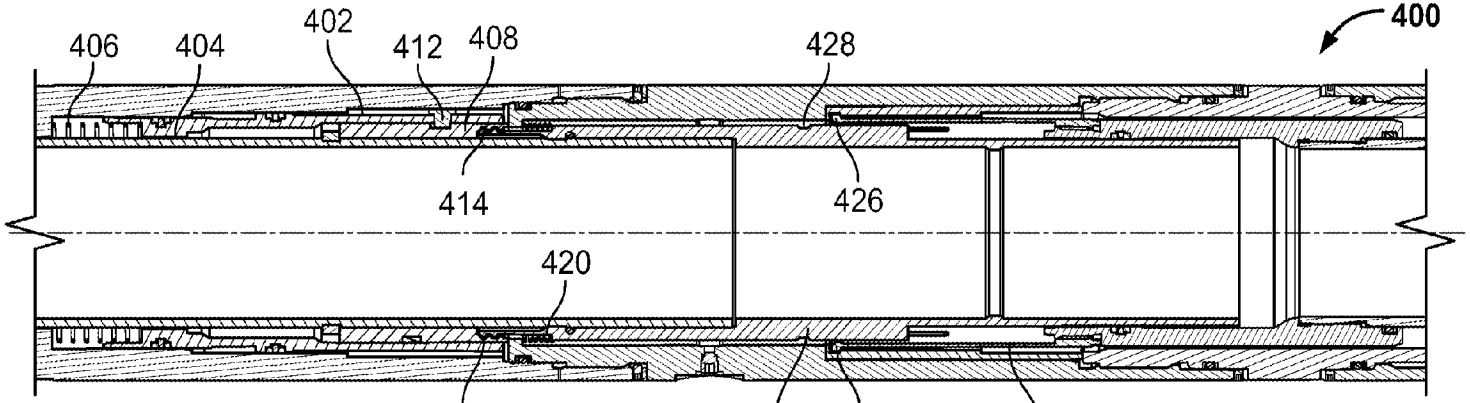

The trigger/reset section 400 operates to trigger actuation of the actuator assembly 220 in response to the remote signal, and also enables resetting the actuator assembly 220 from the actuated state to the unactuated state. As seen in FIG. 4A, the trigger/reset section 400 includes an annular indexing piston 402 carried to reciprocate axially in an annular indexing cavity 404 defined between the sleeve 304 and the housing 202. The indexing piston 402 is sealed to the outer wall of the indexing cavity 404 with axially spaced apart seals 432, and the space between the seals 432 is communicated with the clean hydraulic fluid below piston 308 via passage 310. The indexing piston 402 is also springingly biased to a downhole position by a spring 406 (metallic spring, polymer spring, fluid spring, and/or other type of spring) between the indexing piston 402 and housing 202. The indexing piston 402 is fluidically linked to the fluid isolation piston 308 by the clean hydraulic fluid sealed between the two pistons. Thus, after the indexing piston 402 is moved to the downhole position by the spring 406, and high pressure in the central bore 206 moves the fluid isolation piston 308 downhole, the fluid isolation piston 308 is returned to an uphole position by bleeding off fluid pressure in the central bore 206. Returning the fluid isolation piston 308 to the uphole position creates a low pressure that likewise moves the indexing piston 402 uphole. Raising the pressure in the central bore 206 and then bleeding off pressure below a specified pressure defines one pressure cycle. The spring 406, in part, defines the specified pressure. Notably, the trigger/reset section 400 is not referenced to annulus pressure and the indexing piston 402 is not exposed to annulus pressure; therefore, the specified pressure is independent of annulus pressure. The indexing piston 402 is keyed to the housing 202 so that the indexing piston 402 cannot rotate around the longitudinal axis of the valve 102, but can shift axially as described above.

Figure 5:
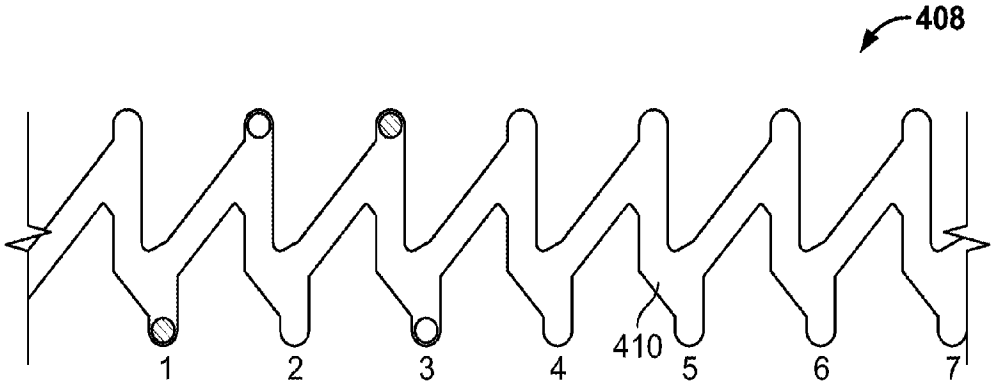

The indexing piston 402 concentrically receives a J-slot rotary ring 408 carried within the housing 202 to rotate about the longitudinal axis of the valve 102 and axially restrained. Referring to FIG. 5, the J-slot rotary ring 408 is shown unrolled, as a flat projection of the ring. The J-slot rotary ring 408 includes a cam slot 410 that is a repeating pattern of generally J-shaped slots, and the indexing piston 402 includes an inwardly facing pin 412 that is received in the cam slot 410. The cam slot 410 is arranged such that as the indexing piston 402 is moved between its uphole and downhole extents, the pin 412 acts on the cam slot 410 to drive the J-slot rotary ring 408 to rotate about the longitudinal axis of the valve 102. The cam slot 410 is biased to cause the J-slot rotary ring 408 to rotate in a specified direction, without counter rotating. The angles on the cam slot 410 are arranged so that during pressuring up over the specified pressure in the central bore 206, there is minimal rotation of the J-slot rotary ring 408, whereas during bleed off there is substantially more rotation. The number of repeating J-shaped slots corresponds to the number of cycles necessary to rotate the J-slot rotary ring 408 a full revolution. For example, FIG. 5 shows a cam slot 410 having seven generally J-shaped slots, and thus requiring seven cycles of the pressure in the central bore 206 to cycle the indexing piston 402 seven times and rotate the J-slot rotary ring 408 a full revolution. Fewer or more J-shaped slots can be provided so that fewer or more cycles are necessary to rotate the J-slot rotary ring 408 through a full revolution.

The downhole end of the J-slot rotary ring 408 includes female threads 414 that internally, threadingly engage male threads 416 of an annular ratch-latch sleeve 418. The ratch-latch sleeve 418 is carried within the housing 202 to reciprocate axially, and is keyed to the housing 202 so that the ratch-latch sleeve 418 cannot rotate around the longitudinal axis of the valve 102. The ratch-latch sleeve 418 is biased apart from the J-slot rotary ring 408 by a spring 420 (metallic spring, polymer spring, fluid spring, and/or other type of spring) between housing 202 and the ratch-latch sleeve 418. However, the threads 414/416, when engaged, maintain the ratch-latch sleeve 418 and J-slot rotary ring 408 together. The threads 414/416 are arranged to unthread when the J-slot rotary ring 408 is rotated a specified number of revolutions by the movement of the indexing piston 402 uphole and downhole. In certain instances, the threads 414/416 are arranged to unthread in two full revolutions of the J-slot rotary ring 408; however, other numbers of revolutions are possible. Thus, when pressure in the central bore 206 is cycled to cycle the fluid isolation piston 308 and the indexing piston 402 fourteen times, it rotates the J-slot rotary ring 408 to unthread the ratch-latch sleeve 418, and releases the ratch-latch sleeve 418 to spring apart from the J-slot rotary ring 408.

The uphole, threaded end of the ratch-latch sleeve 418 (about threads 416) includes one or more axial splits that enable the portion of the ratch-latch sleeve 418 carrying the threads 416 to flex radially inwardly. The threads 416 of the ratch-latch sleeve 418 can thus flex radially and ratchet over the threads 414 of the rotary ring 408 without needing to being screwed together. Therefore, once the ratch-latch sleeve 418 has moved apart from the J-slot rotary ring 408, the ratch-latch sleeve 418 can be recoupled to the J-slot rotary ring 408, and the threads 414/416 recoupled, by driving the ratch-latch sleeve 418 axially into the J-slot rotary ring 408.

The uphole end of the spring mandrel 230 (FIG. 2A) includes one or more latch fingers 422. Each latch finger 422 has an enlarged portion 424 at its end, and each latch finger is configured to flex laterally. The housing 202 has an annular pocket 426 on its inner surface (shown here on a separate element, but could be integral with the housing 202) that receives the enlarged portion 424 of the latch fingers 422 when the ratch-latch sleeve 418 is threadingly engaging the J-slot rotary ring 408, for example, with the actuator assembly 220 in the un-actuated state (e.g., FIG. 2A, FIG. 4A). The inner surface of each latch finger 422 rests on the outer surface of the ratch-latch sleeve 418, trapping the enlarged portion 424 in the annular pocket 426. In the un-actuated state, the power spring 222 tends to drive the spring mandrel 230 downhole, but the latch fingers 422 trapped in the annular pocket 426 support the spring mandrel 230 from moving downhole. The entire axial force of the spring 222 is supported by the interface between the enlarged portion 424 and annular pocket 426, and because the enlarged portions 424 abut a smooth portion of the ratch-latch sleeve 418, the force from the spring 222 is not transmitted to the ratch-latch sleeve 418 or the threads 414/416.

When the ratch-latch sleeve 418 is unthreaded from the J-slot rotary ring 408 and moved apart from the J-slot rotary ring 408, an annular pocket 428 on the outer surface of the ratch-latch sleeve 418 moves under the enlarged portions 424 of the latch fingers 422 and allows the enlarged portions 424 to pull out of the annular pocket 426 of the housing 202. Further movement of the ratch-latch sleeve 418 traps the enlarged portions 424 in the annular pocket 428 of the ratch-latch sleeve 418, so that the spring mandrel 230 and the ratch-latch sleeve 418 move axially together. Releasing the enlarged portions 424 of the latch fingers 422 from the annular pocket 426 of the housing 202 releases the power spring 222 to expand and drive the spring mandrel 230 downhole to move the actuator sleeve 210 and operate the valve closure 204 open.

The trigger/reset section 400 can be reset by gripping a profile 430 on the inner wall of the ratch-latch sleeve 418 and lifting the ratch-latch sleeve 418 uphole until the threads 416 snap into engagement with the threads 414 on the J-slot rotary ring 408. Because the enlarged portions 424 the latch fingers 422 are engaged in the annular pocket 428 on the ratch-latch sleeve 418, the spring mandrel 230 is lifted uphole and the power spring 222 compressed to its unactuated state. When the enlarged portions 424 of the latch fingers 422 reach the annular pocket 426, the annular pocket 426 again receives the enlarged portions 424 of the latch fingers 422. This again decouples the spring mandrel 230 and the power spring 222 from the ratch-latch sleeve 418. The valve 102 can be remotely actuated again by cycling pressure in the central bore 206 to cycle the indexing piston 402, rotate the J-slot rotary ring 408, and unscrew the ratch-latch sleeve 418 from the J-slot rotary ring 408.

A number of examples have been described. Nevertheless, it will be understood that various modifications may be made. Accordingly, other examples are within the scope of the following claims.

What is claimed is:

1. A well tool, comprising:

a housing;

an actuator sleeve in the housing; and an actuator in the housing comprising a spring and an internal shifting tool engaging profile, the actuator responsive, independent of well annulus pressure, to a remote hydraulic signal in a central bore of the well tool to change from an unactuated state, with the spring compressed, to an actuated state, with the spring expanded to shift the actuator sleeve from a first position to a second position, the actuator responsive to reset to the unactuated state when the spring is recompressed using the internal shifting tool engaging profile, and a piston in the housing, the piston responsive, independent of well annulus pressure, to pressure cycles in the central bore to reciprocate in the housing, a spring mandrel in the housing coupled to move with an end of the spring as the spring expands, the spring mandrel comprising a latch finger, a sleeve in the housing comprising threads, the sleeve arranged to grip the latch finger and support the spring mandrel with the spring compressed when the sleeve is in a first position and to release the latch finger when the sleeve is in a second position, and a cam ring coupled to the piston to rotate in the housing by movement of the piston, the cam ring comprising threads that mate with the threads of the sleeve and when mated maintain the sleeve in the first position.

2. The well tool of claim 1, further comprising a valve closure and where the actuator sleeve is coupled to the valve closure and operates the valve closure between an open and closed state when the actuator sleeve is moved between the first position and the second position.

3. The well tool of claim 1, where the threads of the sleeve comprise an axial split to allow the threads to flex radially and ratchet over the threads of the cam ring without being screwed together when the sleeve and cam ring are driven together.

4. The well tool of claim 1, where the cam ring comprises a repeating pattern of generally J-shaped slots and the piston comprises a pin received in the slots.

5. The well tool of claim 1, where the piston is springingly biased to a first position and moves to a second position upon a change of pressure in the central bore.

6. The well tool of claim 1, where the actuator sleeve comprises a second internal shifting tool engaging profile.

7. The well tool of claim 6, where the actuator sleeve is moveable between the first and second position, apart from operation of the actuator, via the second internal shifting tool engaging profile when the actuator is in the unactuated state.

8. The well tool of claim 6, where the actuator sleeve is moveable between the first and second positions, apart from operation of the actuator, via the second internal shifting tool engaging profile when the actuator is in the actuated state.

9. The well tool of claim 1, where, after being reset to the unactuated state, the actuator is responsive to a second remote hydraulic signal in the central bore of the well tool to change from the unactuated state to the actuated state.

10. The well tool of claim 9, where, after changing to the actuated state in response to the second remote hydraulic signal, the actuator is again responsive to reset to the unactuated state when the spring is recompressed using the internal shifting tool engaging profile.

11. A method of actuating a well tool in a well, comprising:

changing to an actuated state in response to a remote hydraulic signal in a central bore of the well tool, independent of well annulus pressure, the changing comprising releasing a spring to shift an actuator sleeve of the well tool;

resetting from the actuated state to an unactauted state when the spring is compressed using a shifting tool manipulated from outside of the well; and where resetting from the actuated state to an unactauted state comprises coupling a threaded connection by ratcheting a first thread portion over a second thread portion.

12. The method of claim 11, where shifting the actuator sleeve moves a valve closure of the well tool between an open and closed state.

13. The method of claim 11, comprising, prior to changing to the actuated state, shifting the actuator sleeve apart from operation of the actuator.

14. The method of claim 11, comprising, prior to changing to the actuated state, shifting the actuator sleeve multiple times between an uphole position and a downhole position apart from operation of the actuator.

15. The method of claim 11, comprising, after changing to the actuated state, shifting the actuator sleeve apart from operation of the actuator.

16. The method of claim 11, where changing to an actuated state in response to a remote hydraulic signal in a central bore of the well tool comprises changing to the actuated state in response to a specified number of pressure cycles in the central bore of the well tool.

17. The method of claim 11, comprising, again, changing to the actuated state in response to a second remote hydraulic signal in the central bore of the well tool.

18. The method of claim 17, comprising, again, resetting from the actuated state to the unactuated state when the spring is compressed using a shifting tool manipulated from outside of the well.

19. The method of claim 11, comprising changing to the actuated state and resetting to the unactuated state multiple times.

20. A device for use in a subterranean well, the device comprising:

an actuator sleeve coupled to an actuated element of the device to operate the actuated element when the actuator shifts axially in the device; and an actuator comprising a spring to act on the actuator sleeve, the actuator responsive, independent of well annulus pressure, to a remotely generated hydraulic signal in a central bore of the device to change from an unactuated state, with the spring compressed, to an actuated state, with the spring expanded to shift the actuator sleeve from a first position to a second position, the actuator responsive to reset to the unactuated state when the spring is recompressed, and in the actuated state a spring mandrel is supported to support the spring compressed by a threaded connection, and in the unactuated state, the threaded connection is unthreaded; and where the threaded connection comprises two parts configured to ratchet together.

21. The device of claim 20, where the actuated element comprises a valve closure.

22. The device of claim 20, where the actuator sleeve is moveable between the first and second position, apart from operation of the actuator.

* * * * *